US006386660B1

(12) United States Patent
Yang

(10) Patent No.: US 6,386,660 B1
(45) Date of Patent: May 14, 2002

(54) DETACHABLE RAIL FOR DRAWERS

(76) Inventor: Jun-Long Yang, No. 33, Da-Hsin 15 St., Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/858,244

(22) Filed: May 15, 2001

(51) Int. Cl.[7] ..... A47B 88/00
(52) U.S. Cl. ..... 312/334.46; 312/334.44
(58) Field of Search ..... 312/334.11, 334.46, 312/334.44, 334.1, 334.7, 334.8, 333; 384/18, 21, 22

(56) References Cited

U.S. PATENT DOCUMENTS 3,923,347 A * 12/1975 Dean ..... 312/334.11
4,998,828 A * 3/1991 Hobbs ..... 312/334.11
5,577,821 A * 11/1996 Chu ..... 312/334.11
5,722,750 A * 3/1998 Chu ..... 312/334.11

* cited by examiner

*Primary Examiner*—Peter M. Cuomo
*Assistant Examiner*—Jerry A. Anderson
(74) *Attorney, Agent, or Firm*—Merchant & Gould P.C.

(57) ABSTRACT

A detachable rail for drawers consists of a track (10) with two blocking elements to limit the movement of the drawer move within the track (10), a bearing race (20) with multiple ball bearings (22), a rail (30) with an attachment device and a latch (40). The structure of the latch (40) and the attachment device of the rails (60) make the removal and re-installation of the drawer easy.

4 Claims, 7 Drawing Sheets

DETACHABLE RAIL FOR DRAWERS

BACKGROUND OF THE INVENTION

1. Field of the Invention

The present invention relates to a detachable rail, especially a detachable rail for furniture that contains drawers to make detachment and installation of the drawers easy.

2. Description of Related Art

Detachable rails are normally used with drawers or keyboard racks of computer desks and are mounted on side faces of the drawers or similar features to mount the drawer or rack in a desk. A conventional detachable rail is usually composed of a ball bearing race slidably mounted between an intermediate rail and an inner rail so the drawers can be easily removed.

For example with reference to FIGS. 6 and 7, a first and a second conventional detachable rail both a sliding frame adapted to be securely on a side face of a drawer. Each sliding frame has a ball bearing race slidably mounted in the sliding frame, and a stop tab and a stop block respectively mounted on opposite ends of the sliding frame to stop the ball bearing race. Additionally, an outer rail is mounted on an inner face of a compartment in the desk to correspond with the sliding frame secured to the drawer or rack. Each outer rail contains an inner rail receiving the ball bearing race of the sliding frame whereby the slide frame is restrictedly slide on the outer rail. To keep the drawer from completely sliding out of the compartment, a resilient strip is secured on the outer rail at a position corresponding to the ball bearing race to limit the movement of the drawer when the resilient strip is stopped by stop elements (stop tab or stop block). The resilient strip can be pressed to release the stop elements so the drawer can be removed from the desk.

However, these conventional detachable rails still have some disadvantages and are inconvenient to use. With reference to FIG. 6, the first conventional rail has a resilient strip (60) with one end securely attached to the outer rail (62) and a flanged outward curve in the mediate portion. The flanged curve slides against the side face of the ball bearing race (64) and abuts an end stop to keep the drawer from inadvertently sliding completely out of the desk. Moreover, the resilient strip (60) is relatively flat and close to the outer rail (62), which makes users have to press hard to release the resilient strip (60) from the stop elements.

With reference to FIG. 7, the second conventional rail has a resilient strip (70) with both ends secured to the inner face of the outer rail (72) to avoid friction between the resilient strip (70) and the ball bearing race (74). Because the thickness of the resilient strip (70) is uneven and a pressing position of the resilient strip (70) is thicker than other positions, the resilient strip (70) is still hard to press to release the drawer from the desk.

To overcome the shortcomings, the present invention provides a detachable rail for drawers to mitigate and obviate the aforementioned problems.

SUMMARY OF THE INVENTION

The main objective of the invention is to provide a detachable rail that is easy to operate and convenient to disassemble and re-assemble.

Other objects, advantages and novel features of the invention will become more apparent from the following detailed description when taken in conjunction with the accompanying drawings.

DETAILED DESCRIPTION OF THE PREFERRED EMBODIMENT

Figure 1:
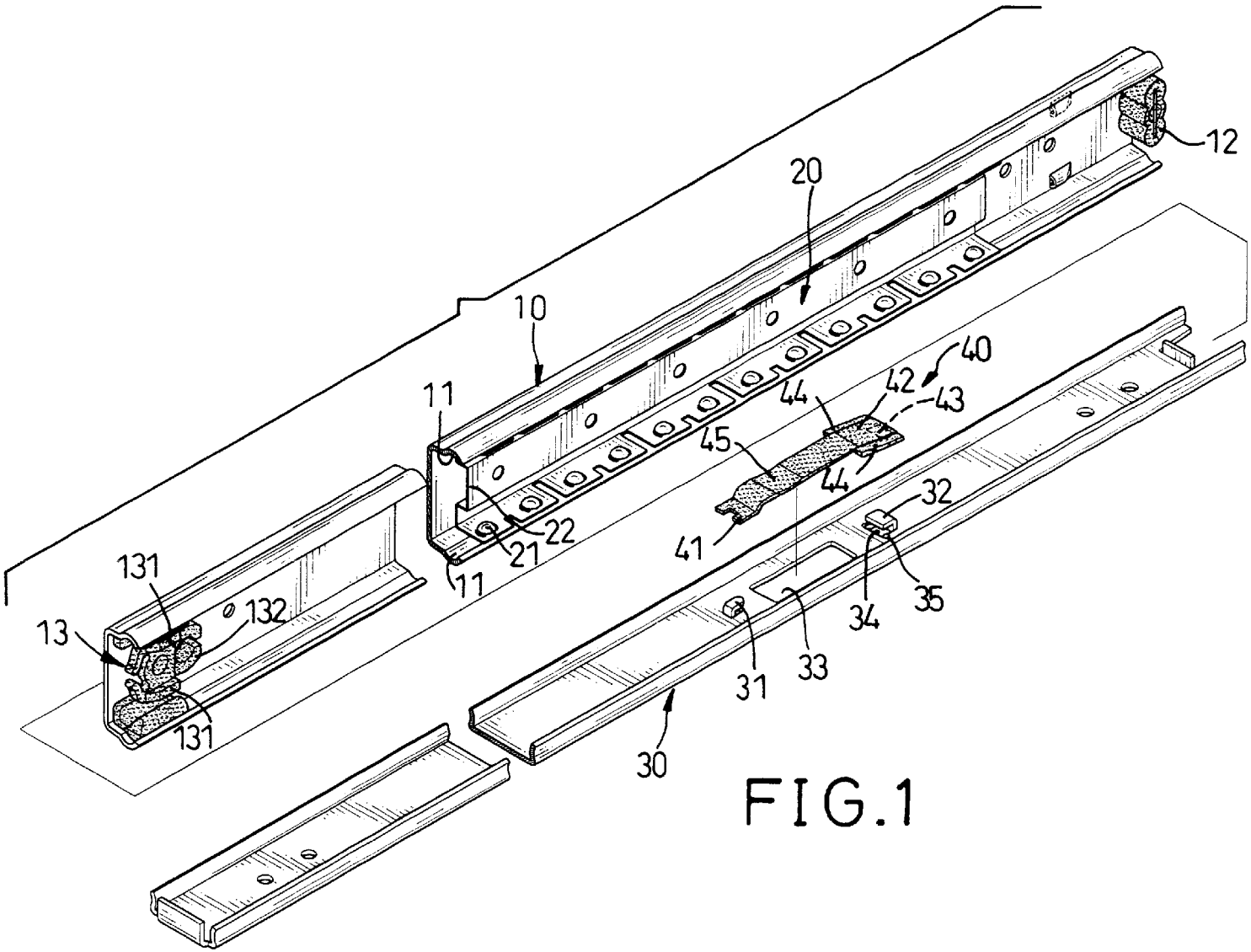
FIG. 1 is an exploded perspective view of a detachable rail in accordance with the present invention.

With reference to FIG. 1, a detachable rail for drawers is composed of a U-shaped track (10), a bearing race (20), a rail (30) and a latch (40).

The track (10) is adapted to be secured on an inner side face of a compartment in furniture and has two guides (11) defined respectively on two sidewalls of the track (10). A limit tab (12) is formed on one end of the track (10) and a limit block (13) is secured on the other end of the track (10). The limit block (13) is made of resilient material such as rubber and has two locking protrusions (131) formed perpendicular and respectively on opposite sides of the limit block (13) and an expandable C-shaped locking clamp (132) formed with the C opening toward the limit tab (12). Each locking protrusion (131) has one flat end near the C-shaped locking clamp (132) and the other end inclined.

The bearing race (20) is substantially U-shaped with an elevated plate (22) formed in a middle portion of the bearing race (20) and is movably mounted on inner faces of the track (10). The bearing race (20) has multiple ball bearings (21) arranged in two lines on the bearing race (20), and the ball bearings (21) are partly received in the guides (11) in the track (10) and roll along the guides (11) to allow the bearing race (20) to move.

Figure 2:
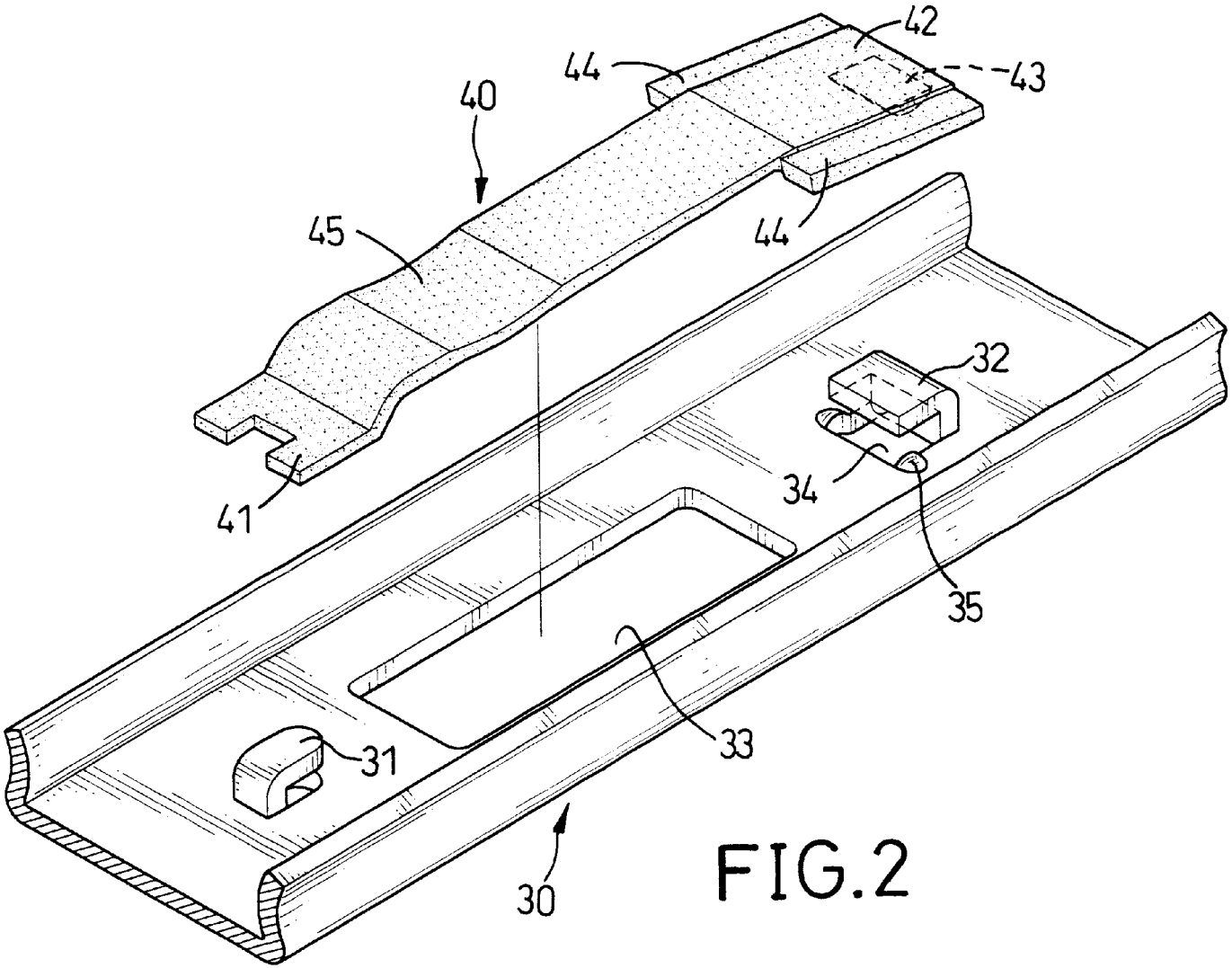
FIG. 2 is an enlarged perspective view of a latch and a segment of a rail with a locking block and attachment hook as part of the detachable rail in FIG. 1.
Figure 3:
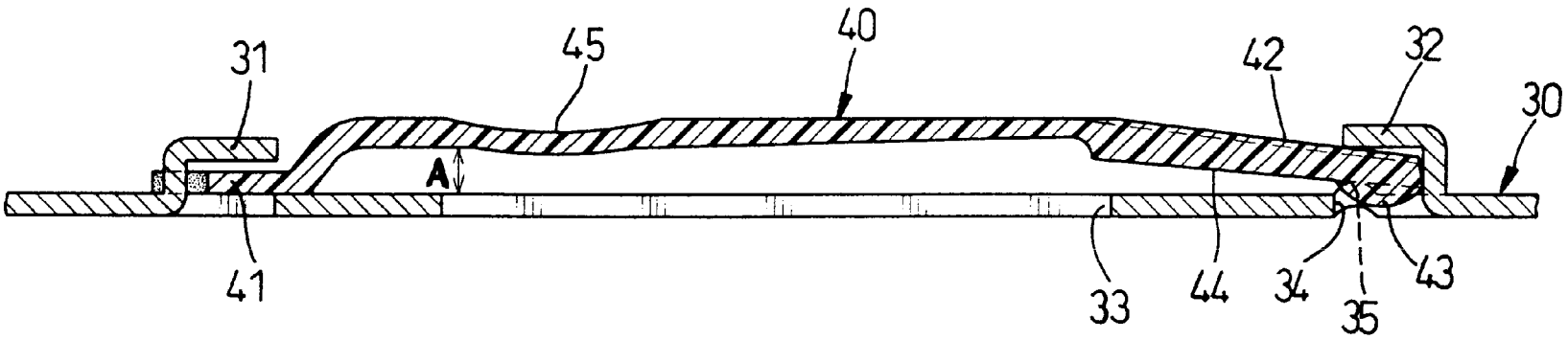
FIG. 3 is an enlarged cross-sectional side plan view of the latch and rail segment in FIG. 2.

With reference to FIGS. 1, 2 and 3, the rail (30) with two side flanges is adapted to be secured on a sidewall of a drawer or similar fixture and to correspond to the track (10). The rail (30) has an attachment hook (31) and a locking block (32). Both are L-shaped, extend up from a bottom face of the rail and face each other. An opening (33) is defined in the bottom face between the attachment hook (31) and the locking block (32). A locking hole (34) is defined in the bottom face under the locking block (32), and two stub (35) are formed on sidewall of the locking hole (34).

The latch (40) is a resilient strip which has a fork (41) formed at one end and an inclined surface (42) formed at the other end. A nub (43) is formed under the inclined surface (42) and a wing (44) protrudes laterally from each side of the inclined surface (42). A concave segment (45) is formed in a middle portion of the latch (40).

With reference to FIG. 3, the latch (40) is attached to the rail (30) by wedging the end of the latch (40) with the inclined surface (42) under the locking block (32) and forcing the nub (43) under the inclined surface (42) into the locking hole (34). The middle portion of the resilient latch (40) is deformed so the fork (41) on the other end of the latch (40) can slide under and clamp the attachment hook (31). With the nub (43) securely held in the locking hole (34) and the fork (41) and the attachment hook (31) interlocked, the latch (40) is attached to the rail (30) with forming a gap (A) and will not rub against the bearing race (20).

Figure 4:
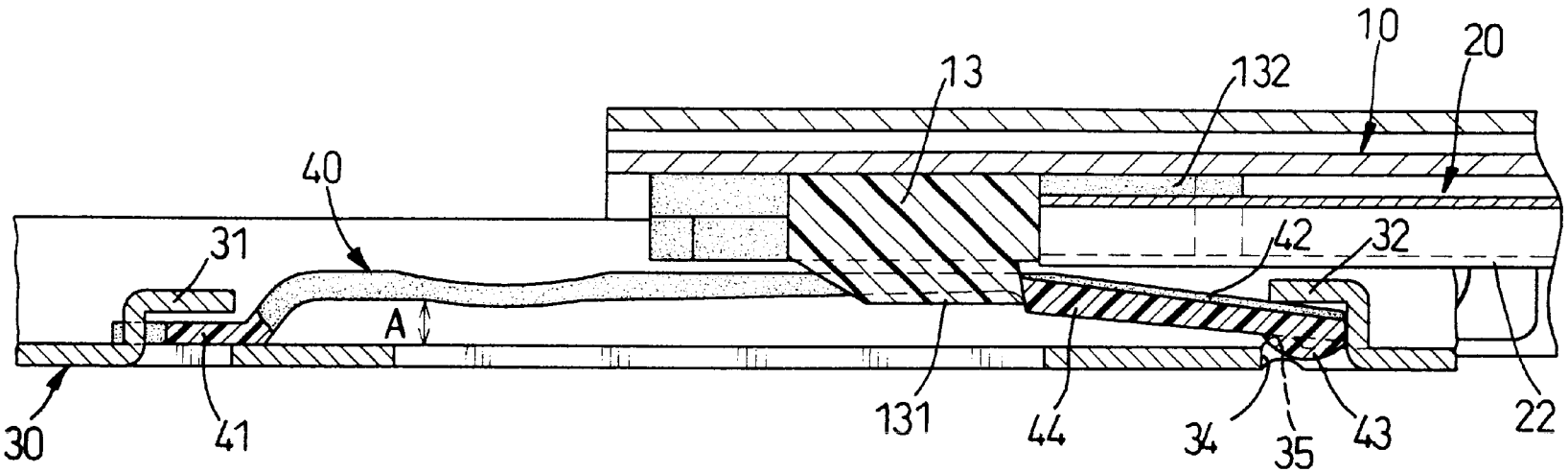
FIG. 4 is an enlarged side plan view in partial section of the detachable rail in FIG. 1 when the latch is locked.

A drawer equipped with the detachable rail as previously described can be easily pulled out of the compartment in furniture by rolling the ball bearings (21) in the bearing race (20) between the track (10) and the rail (30). With reference to FIG. 4, when the drawer is pulled out to a limited position, the locking clamp (132) of the limit block (13) inserts into a space between the elevated plate (22) and the track (1 0). At the same time, the vertical ends of the locking protrusions (131) on the limit block (13) block the wings (44) of the latch (40) so that the rail (30) is retained in the track (10).

Figure 5:
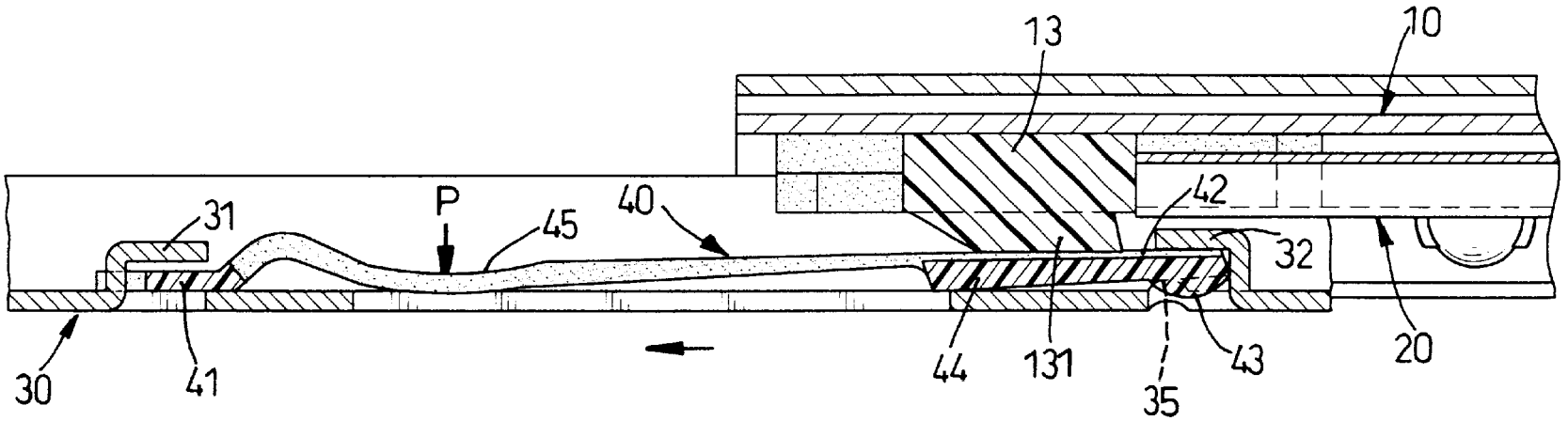
FIG. 5 is an enlarged side plan view in partial section of the detachable rail in FIG. 1. when the latch is unlocked.
Figure 6:
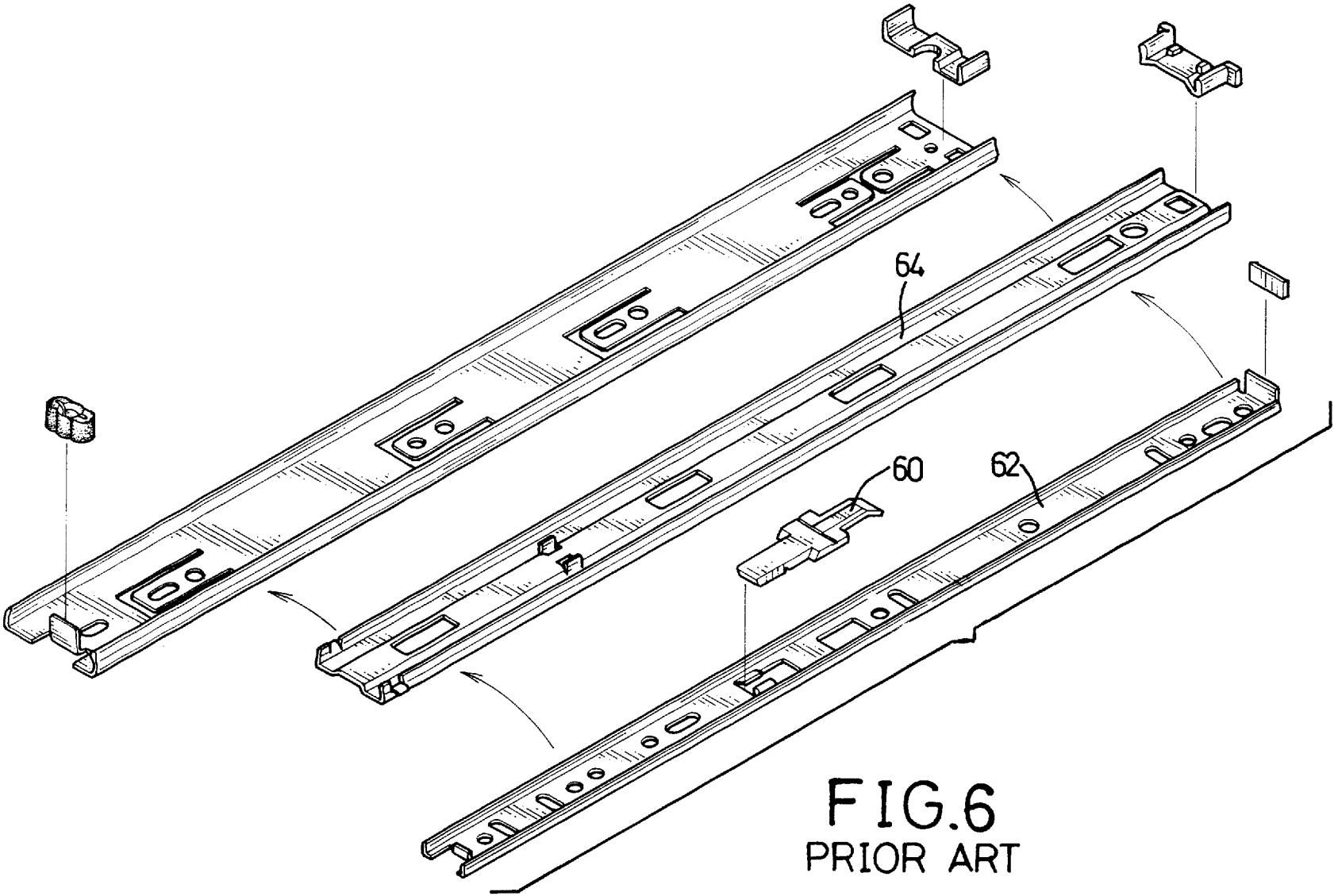
FIG.6 PRIOR ART
FIG. 6 is an exploded perspective view of a first conventional detachable rail in accordance with the prior art.
Figure 7:
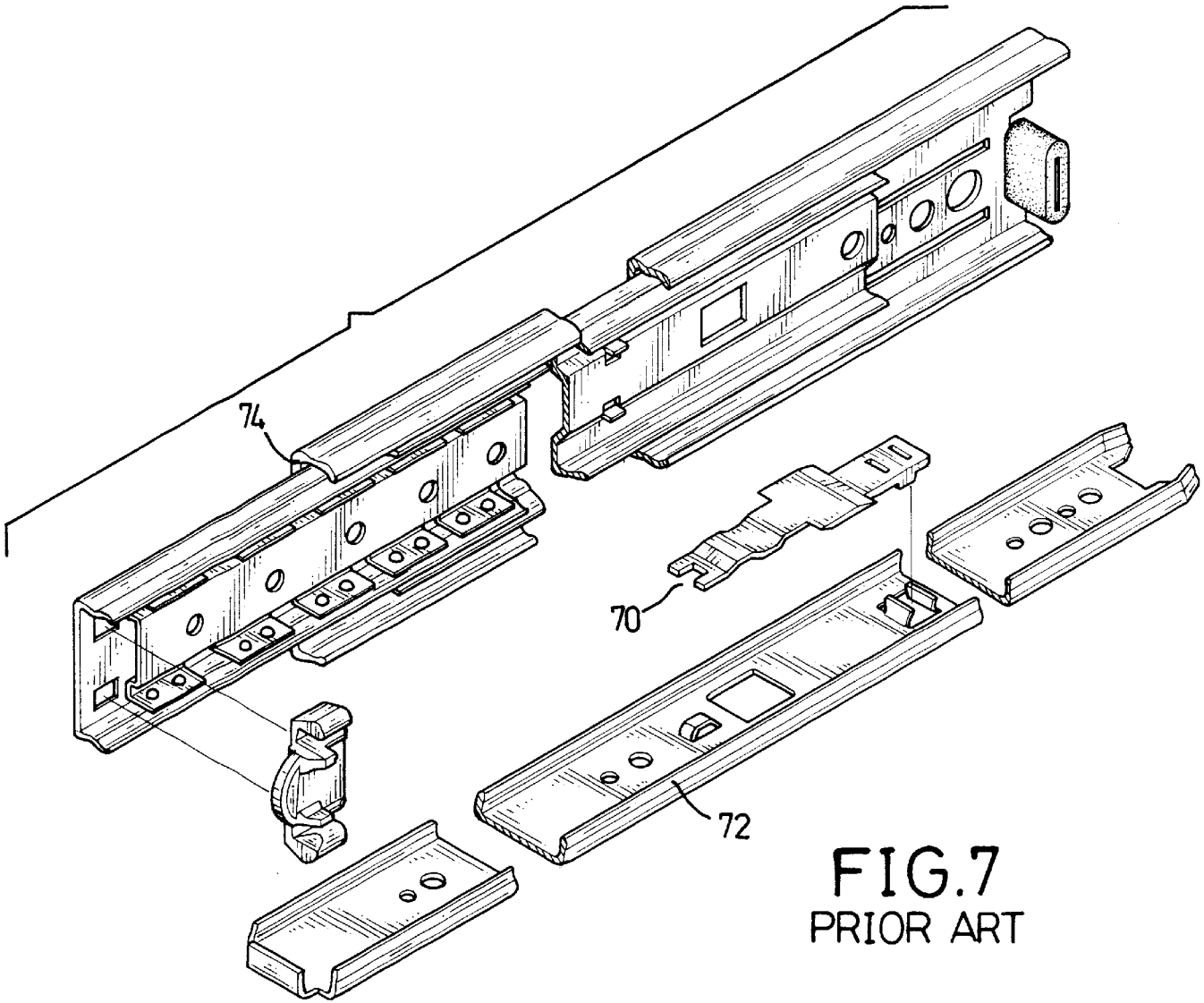
FIG.7 PRIOR ART
FIG. 7 is an exploded perspective view of a second conventional detachable rail in accordance with the prior art.

With reference to FIG. 5, when the drawer is removed from the compartment, the concave segment (45) of the latch (40) is pressed down. Then the wings (44) on the inclined end (42) move down clear of the vertical end so the rail (30) is completely released from the track (10).

In this invention, the latch (40) is curved to make the gap (A) for the latch (40) when the latch (40) is pressed, and the locking hole (34) of the rail (30) receives the nub (43) when the latch (40) is pressed. Therefore, pressing the latch (40) provides a torque force at the nub (43) whereby effort is saved when the drawer is to be removed.

Additionally, when the drawer is re-installed in the compartment, the inclined ends of the locking protrusions (131) guide the latch (40) to a position between the limit tab (12) and the limit block (13).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A detachable rail for drawers comprising:

a track (10) adapted to be secured on furniture to retract a drawer inside and the track (10) having two guides (11) each formed on two sidewalls of the track (10) respectively;

a limit tab (12) and a limit block (13) respectively secured on two ends of the track (10) so as to enclose and limit the movement of the drawer on the track (10);

a bearing race (20) movably secured on inner faces of the track (10) and having multiple ball bearings (21) arranged on the bearing race (20) and partly received in the guide (11) of the track (10) to allow the bearing race (20) to move; and an elevated plate (22) formed in a middle section of the bearing race (20);

a rail (30) adapted to be attached to a drawer or similar fixture to correspond to the track (10) and having two flanges formed on two long sides of the rail (30) to hold the ball bearings (21) of the bearing race (20) to allow the rail (30) to move along the guide (11) in the track (10);

an attachment device mounted on the rail (30); and an opening (33) defined in the rail (30), and a resilient latch (40) attached to the rail (30) by the attachment device;

wherein the improvements comprise:

the limit block (13) having two locking protrusions (131) each formed vertically on opposite sides of the limit block (13) respectively, and each locking protrusion (131) has two ends, one end is a flat end to block the wing (44) of the latch (40) and the other end is an inclined end to guide the rail (30) smoothly into the track (10); and a locking clamp (132) formed on one end of the limit block (13) to be inserted between the elevated plate (22) and the track (10); the resilient latch (40) having a fork (41) formed at one end of the latch (40) to clamp the attachment device;

an inclined surface (42) formed at the other end of the latch (40) and having a nub (43) under the inclined surface (42) to be secured by the attachment device; and two wings (44) protruded laterally from two sides of the inclined surface (42) to contact the limit block (13), wherein a gap (A) is defined between the resilient latch (40) and the rail (30) to allow the movement of the resilient latch (40), so as that the drawer is easily separated from the furniture when the resilient latch (40) is mounted on the rail (30).

2. The detachable rail for drawers as claimed in claim 1, wherein the attachment device is composed of an attachment hook (31) and a locking block (32) facing each other on the rail (30) to secure the fork (41) and the inclined surface (42) respectively, an opening (33) defined in the rail (30) between the attachment hook (31) and the locking block (32) to make a space for the resilient latch (40) when the resilient latch (40) is pressed to detach the drawer; and a locking hole (34) defined in the rail (30) under the locking block (32) to receive the nub (43) under the inclined surface (42) to make the latch (40) to be pressed easily.

3. The detachable rail for drawers as claimed in claim 1, wherein the resilient latch (40) has a concave segment (45) to make the resilient latch (40) to be pressed easily, so as that the wings (44) released from the limit block (13) to make the drawer detach from the furniture.

4. The detachable rail for drawers as claimed in claim 2, wherein the resilient latch (40) has a concave segment (45) to make the resilient latch (40) to be pressed easily, so as that the wings (44) released from the limit block (13) to make the drawer detach from the furniture.

* * * * *